US008360289B2

(12) United States Patent
Thibadeau, Jr. et al.

(10) Patent No.: US 8,360,289 B2
(45) Date of Patent: Jan. 29, 2013

(54) ADJUSTABLE WAIST BELT SYSTEM FOR A CARRYING APPARATUS

(75) Inventors: Thomas Mark Thibadeau, Jr., Sacramento, CA (US); Tabita G. Verumen, San Ysidro, CA (US)

(73) Assignee: Gregory Mountain Products, Sacramento, CA (US)

( * ) Notice: Subject to any disclaimer, the term of this patent is extended or adjusted under 35 U.S.C. 154(b) by 414 days.

(21) Appl. No.: 12/840,501

(22) Filed: Jul. 21, 2010

(65) Prior Publication Data

US 2012/0018479 A1 Jan. 26, 2012

(51) Int. Cl.
*A45F 3/04* (2006.01)

(52) U.S. Cl. ..... 224/637; 224/662

(58) Field of Classification Search ..... 224/625, 224/637, 262, 640, 641, 642, 662; 2/237; 405/186

See application file for complete search history.

(56) References Cited

U.S. PATENT DOCUMENTS

| | | | | |
|---|---|---|---|---|
| 5,337,935 | A * | 8/1994 | Chambonnet | 224/660 |
| 5,860,769 | A * | 1/1999 | Seligman | 405/186 |
| 6,681,973 | B2 | 1/2004 | Crumrine | |
| 6,925,652 | B2 * | 8/2005 | Feng | 2/2.15 |
| 7,540,690 | B2 * | 6/2009 | Garcia et al. | 405/186 |
| 8,066,164 | B2 * | 11/2011 | Gregory | 224/631 |
| 2006/0000856 | A1 * | 1/2006 | West | 224/148.2 |

* cited by examiner

*Primary Examiner* — Justin Larson
(74) *Attorney, Agent, or Firm* — Baker & Associates PLLC; Trent H. Baker

(57) ABSTRACT

One embodiment of the present invention relates to a user-based carrying system, including an enclosure member and a user attachment system. The user attachment system includes a hip attachment system comprising a dorsal pad and a first and second strap member coupled to the enclosure member. The strap members are configured to laterally extend around the waist region of the user. An adjustable coupling between the first and second strap members and the enclosure member includes a first and second male sleeve coupler rigidly coupled to the enclosure member and a plurality of sleeves disposed on each of the first and second padded regions. The first and second male sleeve couplers are disposed within one sleeve on the respective first and second padded region. The distal length of the first and second strap members is dependent on a plurality of sleeves within which the first and second male sleeve couplers are disposed.

20 Claims, 6 Drawing Sheets

ADJUSTABLE WAIST BELT SYSTEM FOR A CARRYING APPARATUS

FIELD OF THE INVENTION

The invention generally relates to backpacks and other carrying systems which encircle a user's waist for support. In particular, the present invention relates to an adjustable waist belt system for improving the performance of a carrying system.

BACKGROUND OF THE INVENTION

Bags and carrying cases are commonly used to transport items from one location to another. Items may be contained and supported within an internal enclosure during transportation. Most bags also include some form of user attachment system that allows a user to support the bag during transportation. Many types of user-based attachment systems are designed to be positioned on a user's body in a configuration that supports the bag without assistance from the user's appendages. For example, backpack shoulder straps may be individually looped around each of a user's shoulders to support the backpack in an orientation that does not require the user to hold it with their arms. However, each type of user attachment system possesses particular performance characteristics and limitations that affect the utility of the bag. For example, a single shoulder strap or messenger style user attachment system is undesirable for exclusive support of a bag with heavier loads due to potential back and/or shoulder discomfort.

Bags and carrying cases may be further classified according to their overall shape, user attachment system(s), and material of composition. One subset of carrying cases includes bags which attach to a user's waist such as backpacks, hip-packs, shoulder bags, messenger bags, etc. These types of carrying systems may also include other user attachment systems such as shoulder straps, handles, etc. in addition to a waist attachment. A waist attachment system refers to some form of straps, belts, hooks, etc. that couple to the waist region of a user. In general, the carrying portion of the carrying system is primarily positioned on the dorsal side of the user, and the waist attachment system includes two straps which extend from the left and right regions to the ventral side of the user's body. The two straps may then be releasably coupled together forming a continuous support strap encircling the user's dorsal and ventral waist region from the carrying portion of the carrying system. By encircling the user's waist with support straps, weight is distributed between the carrying portion of the carrying system and the user's waist. It is advantageous to include rigid padded regions on the waist straps at positions corresponding to the user's hips in order to optimize load distribution and comfort during operation.

One of the problems with conventional waist-type user attachment systems is the inability of the waist attachment system to be efficiently adjusted to optimally correspond to a variety of user waist sizes. Most adjustable waist attachment systems include some form of adjustable straps which may be either lengthened or shortened to accommodate a particular user waist circumference. Unfortunately, merely adjusting the length of the straps fails to optimally align certain portions of the straps with the user's anatomy, resulting in discomfort and/or reduced performance for certain sizes of a user's waist circumference. For example, most waist attachment system straps include a padded region and an adjustable region. The padded region is positioned adjacent to the dorsal side of the user, the remainder of the carrying system, and/or the enclosed region of the carrying system. The adjustable region is usually not padded and extends distally away from the padded region and the enclosed region toward the ventral side of the user to allow for adjustment. The optimal user configuration of the waist attachment system wraps the padded regions over a substantial portion of the user's waist circumference, including the user's dorsal and hip regions, so as to optimize comfort during use. Economically, it is desirable to manufacture a single carrying apparatus that may accommodate a large range of user waist sizes. However, to enable maximum adjustability between small and large user waist circumferences, many waist attachment systems include straps with relatively long, adjustable non-padded regions. Therefore, if user's with a relatively large waist circumference, they must position the adjustable non-padded regions of the straps over portions of their waist, thereby causing discomfort, chaffing, and reduced performance during use.

Therefore, there is a need in the industry for an adjustable waist attachment system that enables adjustment over a range of waist circumference without compromising on the comfort and performance of the carrying system.

SUMMARY OF THE INVENTION

The present invention relates to backpacks and other carrying systems which encircle a user's waist for support. One embodiment of the present invention relates to a user-based carrying system, including an enclosure member and a user attachment system configured to releasably secure the enclosure member to a user. The user attachment system includes a hip attachment system comprising a dorsal pad and a first and second strap member coupled to the enclosure member. The strap members are configured to laterally extend around the waist region of the user and releasably couple at a ventral position, thereby continuously encircling the waist region of the user with the dorsal pad. The first and second strap members include a padded region proximal to the enclosure member, an adjustable region distal to the padded region, and a ventral coupler slidably coupled to the adjustable region. An adjustable coupling between the first and second strap members and the enclosure member includes a first and second male sleeve coupler rigidly coupled to the enclosure member and a plurality of sleeves disposed on each of the first and second padded regions. The first and second male sleeve couplers are disposed within one sleeve on the respective first and second padded region. The distal length of the first and second strap members is dependent on a plurality of sleeves within which the first and second male sleeve couplers are disposed. A second embodiment of the present invention relates to a method for adjusting the circumferential length of a waist attachment system, including the acts of providing a dorsal pad, a first and second strap member, and a first and second male sleeve coupler rigidly coupled to the base member. The method further includes acts of inserting the male sleeve couplers within one of a respective plurality of sleeves disposed on the corresponding padded region.

Embodiments of the present invention represent a significant advance in the field of user-based carrying systems and adjustable waist belt attachment systems. Conventional waist attachment systems are generally only adjustable via a lengthwise slidable adjustment of the releasable ventral couplers. Unfortunately, lengthwise adjustments of the ventral coupler do not enable sufficient adjustability while maintaining the padded regions in a position of optimal comfort on the hips of a user. For example, when a lengthwise ventral coupler adjustment is made to accommodate a large waist circumference, it is unlikely that the padded regions of the waist belt system will be positioned in the optimal anatomical hip position to maximize the performance and comfort. In contrast, embodiments of the present invention teach an adjustability system wherein the entire length of each of the waist belt strap members may be adjusted with respect to the enclosure member and dorsal pad so as to maintain optimal positioning of padded strap member regions. In addition, embodiments of the present invention facilitate the use of rigid members as part of the padded regions of the straps which facilitate improved load distribution across the waist region of the user.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

The following description of the invention can be understood in light of the Figures, which illustrate specific aspects of the invention and are a part of the specification. Together with the following description, the Figures demonstrate and explain the principles of the invention. In the Figures, the physical dimensions may be exaggerated for clarity. The same reference numerals in different drawings represent the same element, and thus their descriptions will be omitted.

DETAILED DESCRIPTION OF THE INVENTION

Figure 1:
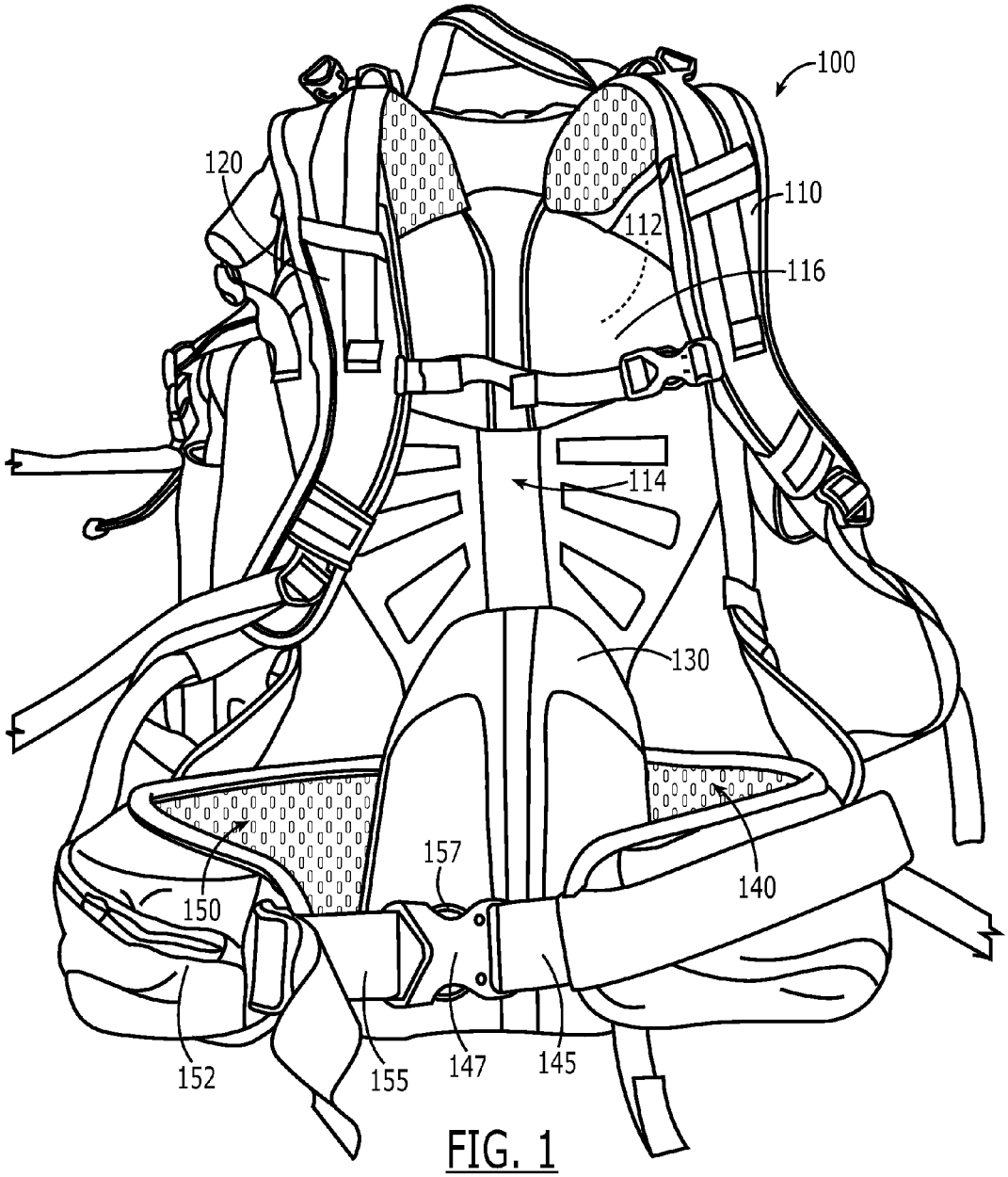
FIG. 1 illustrates a front perspective view of a user-based carrying system in accordance with embodiments of the present invention.

The present invention relates to backpacks and other carrying systems which encircle a user's waist for support. One embodiment of the present invention relates to a user-based carrying system including an enclosure member and a user attachment system configured to releasably secure the enclosure member to a user. The user attachment system includes a hip attachment system comprising a dorsal pad and a first and second strap member coupled to the enclosure member. The strap members are configured to laterally extend around the waist region of the user and releasably couple at a ventral position, thereby continuously encircling the waist region of the user with the dorsal pad. The first and second strap members include a padded region proximal to the enclosure member, an adjustable region distal to the padded region, and a ventral coupler slidably coupled to the adjustable region. An adjustable coupling between the first and second strap members and the enclosure member includes a first and second male sleeve coupler rigidly coupled to the enclosure member and a plurality of sleeves disposed on each of the first and second padded regions. The first and second male sleeve couplers are disposed within one sleeve on the respective first and second padded region. The distal length of the first and second strap members is dependent on a plurality of sleeves within which the first and second male sleeve couplers are disposed. A second embodiment of the present invention relates to a method for adjusting the circumferential length of a waist attachment system, including the acts of providing a dorsal pad, a first and second strap member, and a first and second male sleeve coupler rigidly coupled to the base member. The method further includes acts of inserting the male sleeve couplers within one of a respective plurality of sleeves disposed on the corresponding padded region. Also, while embodiments are described in reference to a waist attachment system for a backpack type carrying system, it will be appreciated that the teachings of the present invention are applicable to other areas. For example, embodiments of the present invention may be utilized for waist attachment systems in conjunction with other types of carrying systems including but not limited to hip packs, tool belts, waist purses, waist belt water carriers, etc.

The following terms are defined as follows:

DEFINITIONS

User-based carrying system—a carrying system configured to be secured to a user. A user-based carrying system may be further defined as being capable of independent transportation, meaning that it does not require a user to maintain active muscular engagement of an appendage for support of the system. For example, backpacks and shoulder bags are user-based carrying systems that allow for independent transportation because they include one or two straps that may be looped over a user's torso during transportation. In contrast, a conventional briefcase is a user-based transportation system in which use is dependent on the user maintaining a continuous grasp of the handle during transportation.

Dorsal pad—a padded member disposed on the dorsal side of a user in proximity to the lumbar spine region. The dorsal pad may be part of a waist attachment system that continuously encircles a user's waist region.

Surface coupler—a releasable coupling mechanism between two surfaces, including but not limited to VELCRO, buttons, snaps, clasps, interlocks, etc.

Coronal plane—a vertical anatomical plane equally splitting the front and rear portion.

Transverse plane—a horizontal anatomical plane equally splitting the top and bottom portion.

Sagittal plane—a vertical anatomical plane equally splitting the left and right side portions.

Waist region—an anatomical region corresponding to the abdominal area around a user's navel. The waist region may also be referred to as the hips and/or the hip region.

Figure 2:
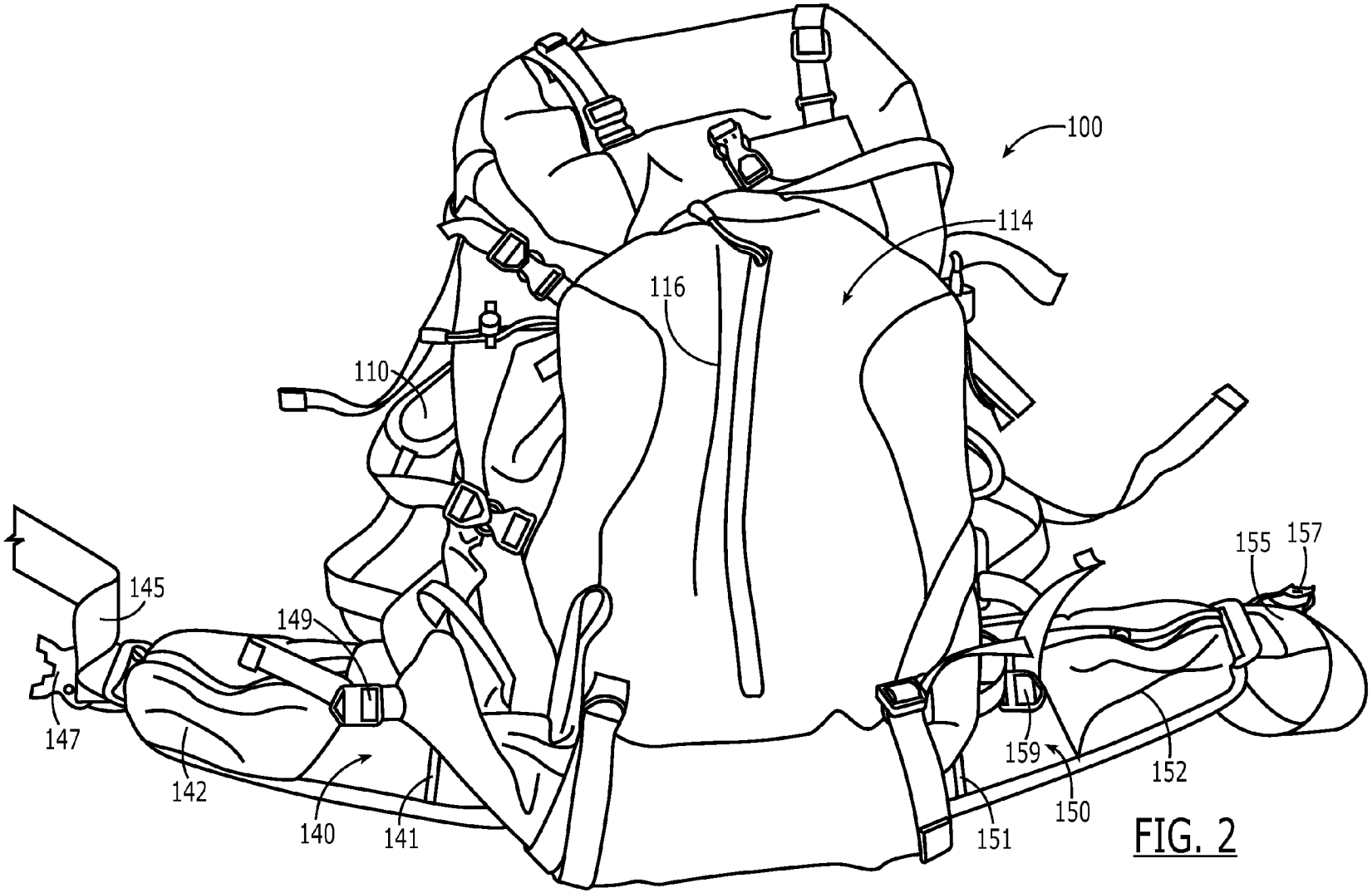
FIG. 2 illustrates a rear perspective view of the user-based carrying system illustrated in FIG. 1.
Figure 3:
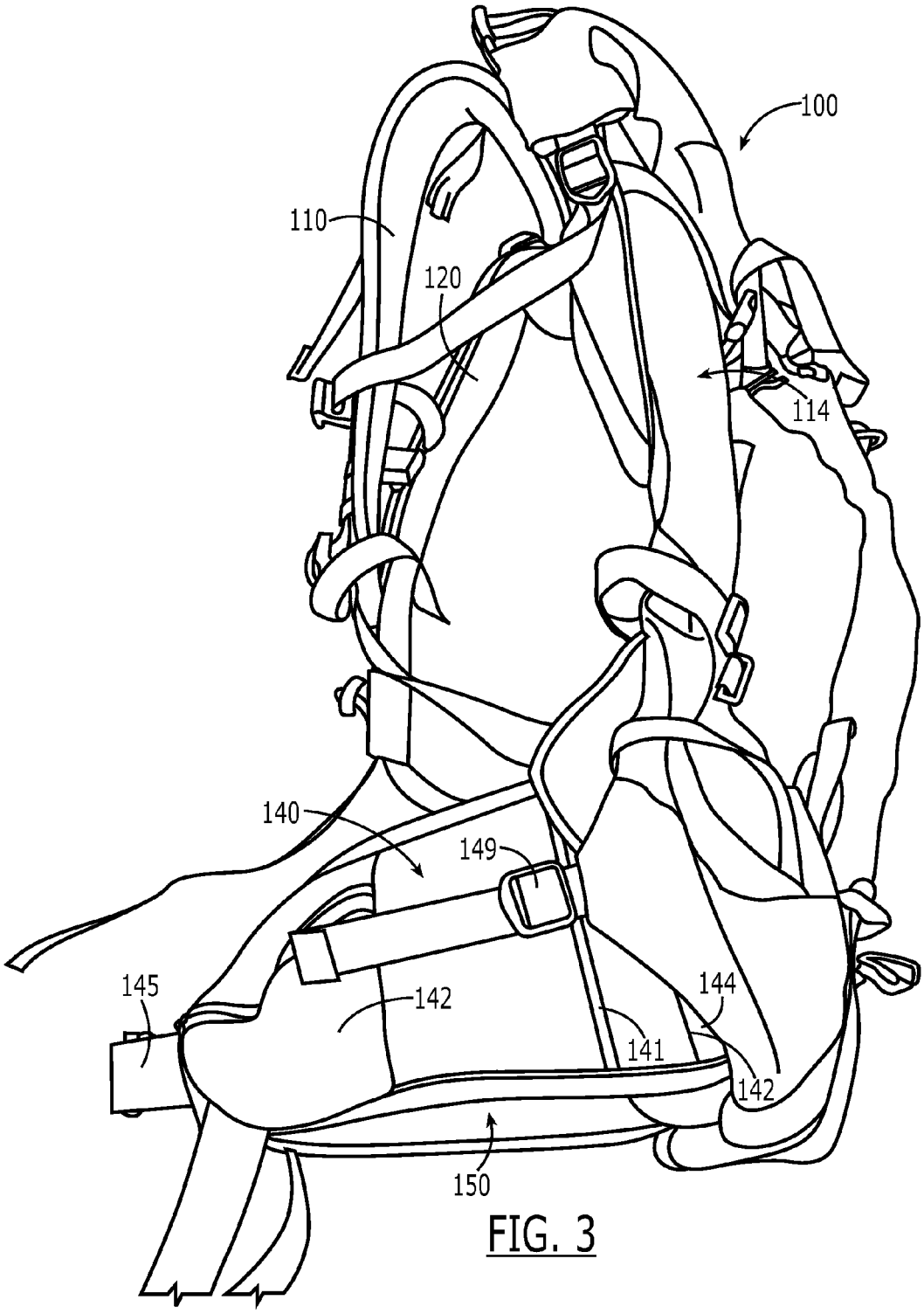
FIG. 3 illustrates a lateral perspective view of user-based carrying system illustrated in FIG. 1.

Reference is initially made to FIGS. 1-3, which illustrate front, rear, and profile views of a carrying system in accordance with embodiments of the present invention, designated generally at 100. The front (FIG. 1) side of the system 100 is configured to be disposed on the dorsal side of a user during operation. The rear (FIG. 2) side of the system is configured to be oriented away from the user and/or exposed during operation. Likewise, the sides (FIG. 3) of the system are configured to be oriented coronally with respect to the user during operation. The illustrated system 100 is a backpack with an enclosure member 114 having an internal region 112 substantially encased by an internal surface. The enclosure member 114 further includes an external surface 116 opposite the internal surface. The system 100 may be used to transport items contained within the internal region 112 of the enclosure member 114. Various types of releasable openings may be utilized to provide releasable access to the internal region 112, including but not limited to a lid, zipper, flap, roll top opening, etc. In addition, it will be appreciated that various auxiliary internal regions may be disposed on or within the enclosure member 114 to facilitate various functionalities such as storage item separation, access convenience, load distribution, etc. Various compression straps, storage straps, and accessory loops may also be disposed on the external surface 116 of the enclosure member 114 in accordance with embodiments of the present invention. The illustrated system 100 further includes a set of shoulder straps 110, 120 to be incorporated as a user attachment system. The first and second shoulder straps 110, 120 may be looped around the ventral side of a user's shoulders during operation.

The system further includes a waist attachment system including a dorsal pad 130, a first waist strap 140, 145, and a second waist strap 150, 155. In operation, the dorsal pad 130 and the waist straps 140, 145, 150, 155 are configured to continuously encircle the waist region of a user so as to absorb and distribute load bearing forces from the enclosure member transversely across the waist attachment system and corresponding waist region of the user. The dorsal pad 130 is coupled to the external surface 116 of the enclosure member 114 at a region corresponding to the lumbar of a user during operation. The first and second waist straps 140, 145, 150, 155 are adjustably coupled to the enclosure member 114. The adjustable coupling scheme will be described in more detail below with reference to FIGS. 4-6. The dorsal pad 130 is substantially centered with respect to the front side of the external surface 116 to correspond sagitally to the middle of a user's lumbar region during operation. The coupling between the dorsal pad 130 and the external surface 116 includes a hollow transverse channel extending from one side of the system 100 to the other. The first waist strap 140, 145 further includes a first padded region 140 and a first adjustable region 145. The second waist strap 150, 155 further includes a second padded region 150 and a second adjustable region 155.

The first and second padded and adjustable regions 140, 150, 145, 155 further include an internal surface oriented toward the user during operation and an external surface oriented opposite and/or away from the user during operation. The first and second padded regions 140, 150 include padded members configured to absorb compression and support forces around the waist region of a user. The padded members may include foam and/or other force absorbing materials. The padded regions 140, 150 are disposed proximally to the enclosure member 114 and the dorsal pad 130 with respect to the adjustable regions 145, 155. The padded regions 140, 150 are shaped in an elongated half oval like manner to facilitate covering the waist region of a user. The padded regions 140, 150 are shaped and oriented to extend lengthwise from the dorsal pad 130 and lumbar region of a user in a transverse orientation toward the ventral side of the user. The padded regions 140, 150 are configured to cover the entire hip regions of the user such that the force absorbing padded members are disposed along the hip bones on either side of the user. As will be discussed below, the adjustable coupling between the waist straps 140, 145, 150, 155 and the enclosure member 114 enable the proper positioning of the padded regions 140, 150 around the hip bones over a large range of anatomical user waist circumferences. The padded regions 140, 150 include a plurality of sleeves 141, 142, 143, 151, 152, 153 configured to selectively interface with a first and second male sleeve coupler 144, 154 coupled to the enclosure member 114. In addition, the padded regions 140, 150 may further include a first and second hip coupler 149, 159. The hip couplers 149, 159 are adjustable strap systems between the external surface 116 of the enclosure member 114 and the external surface of the padded regions 140, 150. The padded regions 140, 150 may also include a first and second auxiliary enclosure 142, 152 to releasably house items for storage.

The first and second adjustable regions 145, 155 are disposed distally from the padded regions 140, 150 on the waist straps 140, 145, 150, 155. The adjustable regions 145, 155 are non-padded elongated members configured to facilitate a slidable adjustment of a ventral coupling scheme. The adjustable regions 145, 155 may be composed of a nylon webbing material configured to be flexible yet substantially rigid under tensile extension. The adjustable regions 145, 155 include a respective first and second ventral coupler 147, 157 configured to releasably couple with one another on the ventral naval region of the user. The ventral couplers 147, 157 may be translated or elongated along the adjustable regions 145, 155 to change the overall circumference of the dorsal pad 130 and the waist straps 140, 145, 150, 155. However, as discussed below, the adjustable coupling of the waist straps 140, 145, 150, 155 to the enclosure member 114 is the primary or initial form of adjustment for the overall circumference. Therefore, the translation or elongation of the ventral couplers 147, 157 may be used as a secondary or fine adjustment system after the proper adjustment of the waist straps 140, 145, 150, 155 with respect to the enclosure member 114 is made. Rather than directly translating the ventral couplers 147, 157 along the adjustable regions 145, 155, the illustrated adjustability scheme includes both the ventral couplers 147, 157 and a secondary adjustment buckle disposed on the padded regions 140, 150 to adjust a loop of the adjustable regions 145, 155 at which the ventral couplers 147, 157 are distally disposed. It will be appreciated that any ventral coupler adjustability scheme may be utilized in accordance with embodiments of the present invention. In addition, the ventral couplers 147, 157 may be composed of any form of releasable coupling mechanism including but not limited to SNAP LOCKS, buckles, knots, etc.

Figure 4:
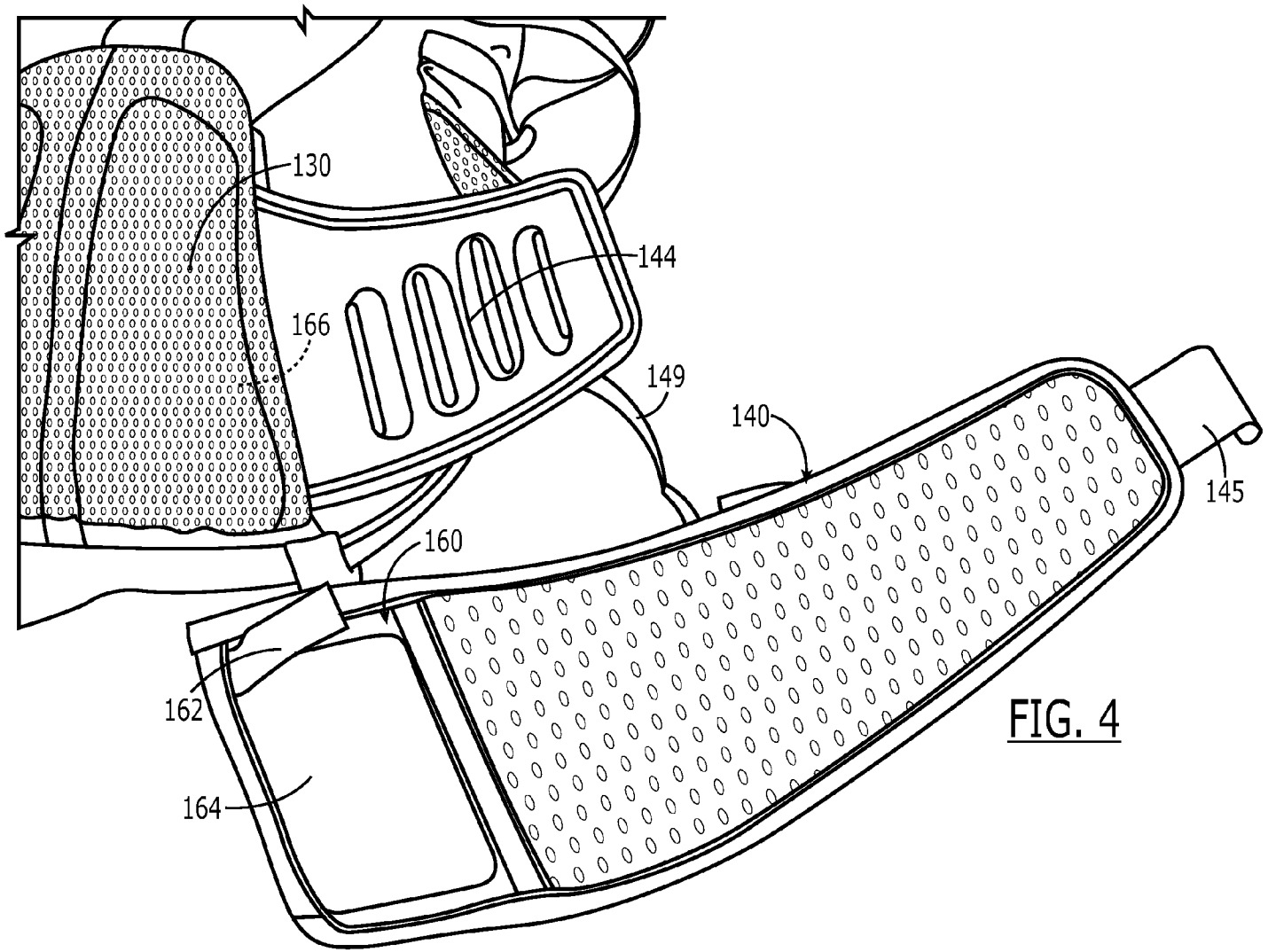
FIG. 4 illustrates an perspective view of the internal surface of a disengaged first strap member and first male sleeve coupler of the user-based carrying system illustrated in FIG. 1.
Figure 5:
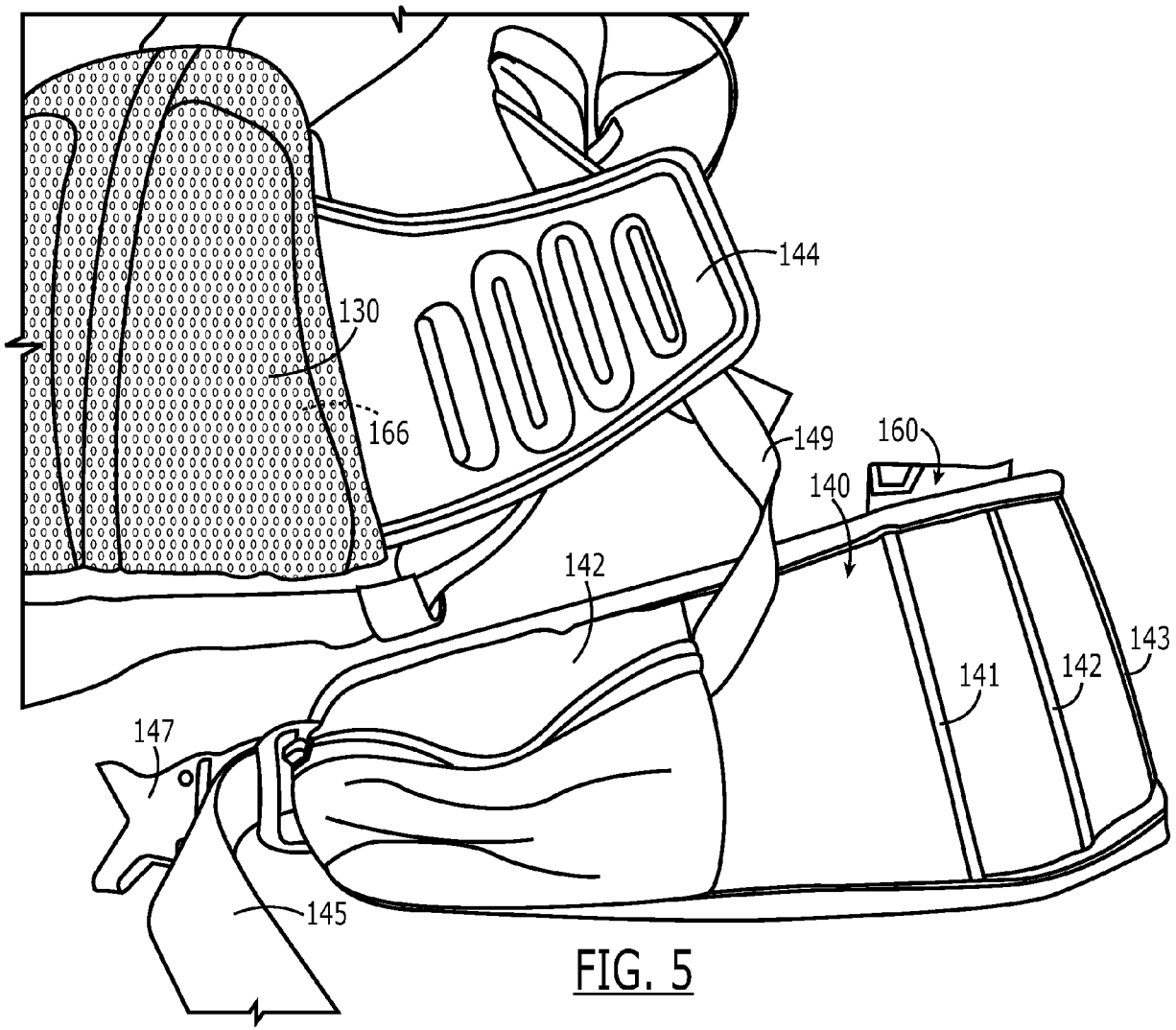
FIG. 5 illustrates a perspective view of the external surface of a disengaged first strap member and first male sleeve coupler of the user-based carrying system illustrated in FIG. 1.
Figure 6:
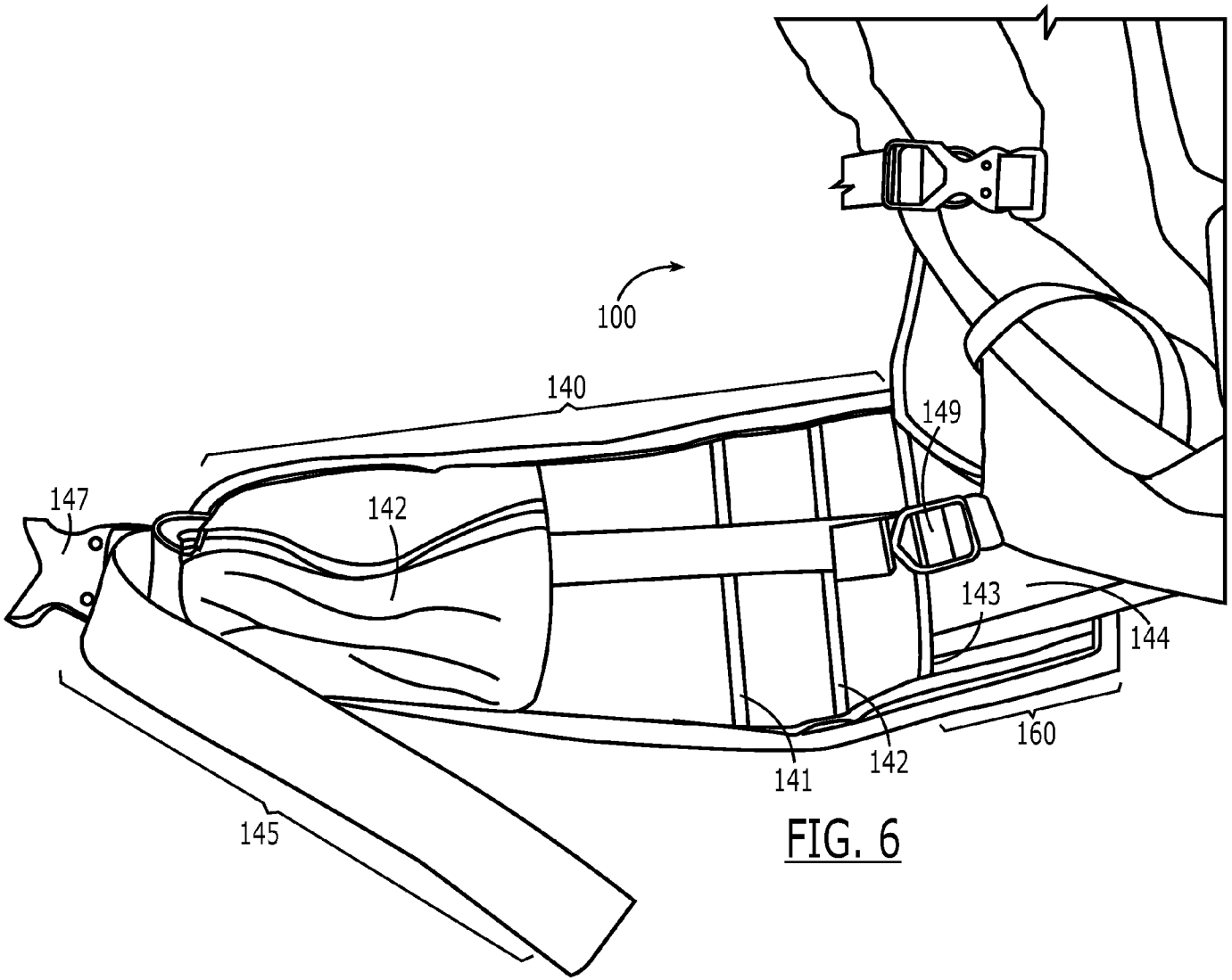
FIG. 6 illustrates a perspective view of the external surface of an engaged first strap member and first male sleeve coupler of the user-based carrying system illustrated in FIG. 1.

Reference is next made to FIGS. 4-6, which illustrate operational views of the adjustable coupling system between the waist straps 140, 145, 150, 155 and the enclosure member 114. In particular, FIG. 4 illustrates the internal side of the first waist strap 140, 145 in a disengaged state from the enclosure member 114. FIG. 5 illustrates the external side of the first waist strap 140, 145 in a disengaged state from the enclosure member 114. FIG. 6 illustrates the external side of the first waist strap 140, 145 in a selectively engaged state with the enclosure member 114 via the first male sleeve coupler 144. The adjustable coupling system between the waist straps 140, 145, 150, 155 and the enclosure member 114 provides a novel and efficient adjustability system by which the overall circumference of the waist attachment system may be adjusted while maintaining optimal positioning of the padded regions 140, 150 with respect to the user's hip bones. The adjustable coupling allows the coupling point of padded regions 140, 150 to be selectively adjusted in the transverse plane so as adjust the respective length of the padded regions 140, 150 and the overall waist straps 140, 145, 150, 155 with respect to the dorsal pad 130 and the enclosure member 114.

The adjustable coupling between the waist straps 140, 145, 150, 155 and the enclosure member 114 further includes a selective coupling between a male sleeve coupler 144, 154 and one of a plurality of sleeves 141, 142, 143, 151, 152, 153. The first and second male sleeve couplers 144, 154 are rigidly and/or fixably coupled to the enclosure member 114 within the channel between the dorsal pad 130 and the enclosure member. The rigid coupling of the male sleeve couplers 144, 154 to the enclosure member 114 may include a fixed stitch type coupling. The male sleeve couplers 144, 154 extend laterally in a transverse orientation with respect to the dorsal pad 130 and the enclosure member 114. The male sleeve couplers 144, 154 may be composed of a supportive, partially rigid material, including but not limited to plastic. It will be appreciated that the relative rigidity of the male sleeve couplers 144, 154 may be adjusted to increase load distribution. For example, on a larger backpack, it may be beneficial to utilize male sleeve couplers 144, 154 that have a higher rigidity so as to correspond to a heavier load. In operation, the rigidity and stiffness of the male sleeve couplers 144, 154 increases the load distribution from the enclosure member 114 across the waist attachment system. The first padded region 140 includes a first small sleeve 141, a first medium sleeve 142, and a first large sleeve 143. Likewise, the second padded region 150 includes a second small sleeve 151, a second medium sleeve 152, and a second large sleeve 153. The designators of "small", "medium", and "large" correspond to the relative adjustments of the particular sleeves and may alternatively be replaced by sequential numbers or other designators. For example, a user with a waist circumference within a particular range may be categorized as small and will thus correspond to the small sleeves 141, 151. The plurality of sleeves 141, 142, 143, 151, 152, 153 are specifically shaped to correspond to the male sleeve couplers 144, 154 to enable a keyed male-female type engagement. Therefore, the particular shape of the sleeves 141, 142, 143, 151, 152, 153 and/or the corresponding male sleeve couplers 144, 154 may be adjusted to achieve particular secondary objectives such as weight or optimal manufacturing. In operation, the male sleeve couplers 144, 154 may be selectively inserted into one of the plurality of sleeve 141, 142, 143, 151, 152, 153 to effectuate a particular transverse positional length adjustment of the respective waist strap 140, 145, 150, 155 with respect to the enclosure member 114. For example, in a disengaged state (FIGS. 4-5), the first male sleeve coupler 144 may be selectively inserted into one of the first small sleeve 141, first medium sleeve 142, or first large sleeve 143 to couple the first padded region 140 to the enclosure member at a particular length corresponding to the sleeve selection.

In addition to the sleeve system, the adjustable coupling between the waist straps 140, 145, 150, 155 may further include a surface coupling between the padded regions 140, 150 and the enclosure member 114. In the illustrated embodiment, the first padded region 140 further includes a first dorsal coupling region 160. It will be appreciated that although not illustrated, the second padded region 150 includes a corresponding second dorsal coupling region configured in substantially the same manner. The first dorsal coupling region 160 is disposed on the proximal side of the first padded region 140 with respect to the enclosure member 114. The first dorsal coupling region 160 is configured to be substantially disposed between the dorsal pad 130 and the enclosure member 114 in an engaged state (see FIG. 1). The internal surface of the first dorsal coupling region 160 (see FIG. 4) includes a first releasable surface coupling member 164 and a first tab 162. The illustrated first releasable surface coupling member 164 includes a VELCRO member, but it will be appreciated that any type of surface coupler may be utilized including but not limited to a button, clasp, etc. A first internal releasable surface coupling member 166 is disposed on the external surface 116 of the enclosure member 114 at a location under the dorsal pad 130. The first internal releasable surface coupling member 166 is configured to correspond and selectively releasably couple with the first releasable surface coupling member 164 in response to a particular coupling/compression force therebetween. In operation, while the first male sleeve coupler 144 is inserted within the respective first sleeve 141, 142, 143, the coupling region 160 may be folded over adjacent to the dorsal pad 130. The coupling region 160 may then be unfolded and routed between the dorsal pad 130 and the enclosure member 114. A releasable engagement may then be activated between the first internal releasable surface coupling member 166 on the enclosure member 114 and the releasable surface coupling member 164 on the coupling region 160 of the first padded region 140. It will be noted that the first coupling region 160 or the second coupling region (not shown) may include a secondary releasable surface coupling member on the respective external side of the padded region to enable an overlapping coupling of the coupling regions to the enclosure member 114 below the dorsal pad 130. The first tab 162 disposed on the first coupling region 160 may be used to disengage the releasable surface coupling between the first internal releasable surface coupler 166 and the first releasable surface coupler 164.

In operation, a user may disengage both waist straps 140, 145, 150, 155 from the enclosure member 114 to adjust the length of the waist straps 140, 145, 150, 155 to properly correspond to the user's unique anatomical waist circumference. One embodiment of this method for adjustment will be described to correspond to the illustrated carrying system 100 embodiment. It will be appreciated that various alternative steps, acts, and methodologies may also be utilized to perform the adjustment of systems in accordance with embodiments of the present invention. The method of adjustment for the illustrated embodiment includes an act of initially disengaging the waist straps 140, 145, 150, 155 from the enclosure member 114. The act of disengaging may include loosening, extending, and/or releasing the hip couplers 149, 159 between the padded regions 140, 150 and the enclosure member 114. The user may engage and pull the tabs 162 on the coupling regions 160 of the first and second waist straps 140, 145, 150, 155 to disengage the surface coupling of the waist straps 140, 145, 150, 155 to the enclosure member 114 disposed under the dorsal pad 130. The user may then extend the padded regions 140, 150 away from the enclosure member 114, thereby disengaging the male sleeve couplers 144, 154 from the respective sleeves 141, 142, 143, 151, 152, 153. Once the waist straps 140, 145, 150, 155 are disengaged at the surface couplers and the sleeve couplings, the user may then reinsert the male sleeve couplers 144, 154 into the appropriate respective sleeves 141, 142, 143, 151, 152, 153 that correspond to his/her anatomical waist circumference. While the user is reinserting the male sleeve couplers 144, 154, the coupling regions 160 may be folded toward the internal side of the padded regions 140, 150. The user may then unfold the coupling regions 160 and reroute the coupling regions between the dorsal pad 130 and the enclosure member 114. The rerouting of the coupling regions 160 may include engaging the surface coupling between the coupling region and the enclosure member. The user may then tighten the hip couplers 149, 159 to accommodate the particular selected length of the padded regions 140, 150 with respect to the enclosure member 114.

It should be noted that various alternative system designs may be practiced in accordance with the present invention, including one or more portions or concepts of the embodiment illustrated in FIG. 1 or described above. Various other embodiments have been contemplated, including combinations in whole or in part of the embodiments described above.

What is claimed is:

1. A user-based carrying system capable of independent transportation of a load, comprising:

an enclosure member having an internal region substantially encased by an internal surface, wherein the enclosure member includes an external surface opposite the internal surface;

a user attachment system configured to releasably secure the enclosure member to a user, wherein the user attachment system includes a hip attachment system comprising:

a dorsal pad coupled to the enclosure member; and a first and second strap member adjustably coupled to the enclosure member, wherein the strap members are configured to laterally extend around the waist region of the user and releasably couple at a ventral waist region thereby continuously encircling the waist region of the user with the dorsal pad, wherein the first and second strap members include a padded region proximal to the enclosure member, an adjustable region distal of the padded region, and a ventral coupler slidably coupled to the adjustable region;

wherein, the adjustable coupling between the first and second strap members and the enclosure member further comprises:

a first and second male sleeve coupler rigidly coupled to the enclosure member; and a plurality of sleeves disposed on each of the first and second padded regions, and wherein the first and second male sleeve couplers are disposed within any one of said plurality of sleeves on the respective first and second padded region.

2. The user-based carrying system of claim 1, wherein the first and second padded regions further include a first and second dorsal coupling region configured to releasably couple to the enclosure member between the dorsal pad and the enclosure member.

3. The user-based carrying system of claim 1, wherein the first and second strap members are coupled to the enclosure member via a releasable surface coupling between the dorsal pad and the enclosure member.

4. The user-based carrying system of claim 3, wherein the releasable surface coupling includes a releasable coupling scheme.

5. The user-based carrying system of claim 1, wherein the distal length of the first and second strap members with respect to the dorsal pad depends upon which of the corresponding sleeves within which the corresponding male sleeve coupler is disposed.

6. The user-based carrying system of claim 1, wherein the first and second strap members are coupled to the enclosure member between the dorsal pad and the enclosure member.

7. The user-based carrying system of claim 1, wherein the plurality of sleeves on the first and second padded region are disposed at independent distal locations along the padded regions, and wherein the plurality of sleeves are geometrically shaped to receive the corresponding male sleeve coupler.

8. The user-based carrying system of claim 1, wherein the first and second padded regions include an external surface and an internal surface, and wherein the internal surface is oriented to be proximal to a user in an engaged state, and wherein the plurality of sleeves are disposed on the external surfaces of the first and second padded regions.

9. The user-based carrying system of claim 8, wherein the internal surface of the first and second padded regions include a padded member.

10. The user-based carrying system of claim 1, wherein the first and second strap members further include a first and second adjustable hip coupler extending between the enclosure member and the corresponding padded region.

11. The user-based carrying system of claim 1, wherein the ventral couplers adjustably coupled to the adjustable regions of the first and second strap members may be translated lengthwise along the adjustable regions to adjustable the circumference of the continuous encircling of the strap members around the waist region of a user.

12. An adjustable user-based waist attachment system for supporting a base member comprising:

a dorsal pad coupled to the base member;

a first and second strap member adjustably coupled to the base member, wherein the strap members are configured to laterally extend around the waist region of the user and releasably couple at a ventral waist region thereby continuously encircling the waist region of the user with the dorsal pad, wherein the first and second strap members include a padded region proximal to the base member, an adjustable region distal of the padded region, and a ventral coupler slidably coupled to the adjustable region;

wherein, the adjustable coupling between the first and second strap members and the base member further comprises:

a first and second male sleeve coupler rigidly coupled to the base member; and a plurality of sleeves disposed on each of the first and second padded regions, and wherein the first and second male sleeve couplers are disposed within any one of said plurality of sleeves on the respective first and second padded region.

13. The adjustable user-based waist attachment system of claim 12, wherein the first and second padded regions further include a first and second dorsal coupling region configured to releasably couple to the base member between the dorsal pad and the base member.

14. The adjustable user-based waist attachment system of claim 12, wherein the plurality of sleeves on the first and second padded region are disposed at independent distal locations along the padded regions, and wherein the plurality of sleeves are geometrically shaped to receive the corresponding male sleeve coupler.

15. The adjustable user-based waist attachment system of claim 12, wherein the distal length of the first and second strap members with respect to the dorsal pad depends upon which of the corresponding sleeves within which the corresponding male sleeve coupler is disposed.

16. A method for adjusting the circumferential length of a waist attachment system comprising the acts of:

providing a dorsal pad coupled to a base member;

providing a first and second strap member coupled to the dorsal pad, wherein the first and second strap member include a padded region proximal to the base member, an adjustable region distal of the padded region, and a ventral coupler slidably coupled to the adjustable region;

providing a first and second male sleeve coupler rigidly coupled to the base member; and inserting the first male sleeve coupler within one of a plurality of sleeves disposed on the first padded region; and inserting the second male sleeve coupler within any one of a plurality of sleeves disposed on the second padded region.

17. The method of claim 16, wherein the act of inserting the first male sleeve coupler within one of a plurality of sleeves disposed on the first padded region further includes releasably surface coupling the first padded region to the first male coupler.

18. The method of claim 17, wherein the act of inserting the second male sleeve coupler within one of a plurality of sleeves disposed on the second padded region further includes releasably surface coupling the second padded region to the second male coupler.

19. The method of claim 17, wherein the act of releasably surface coupling the first padded region to the first male coupler includes surface coupling the first padded region to the first male coupling region between the dorsal pad and the base member.

20. The method of claim 18, wherein the act of releasably surface coupling the second padded region to the second male coupler includes surface coupling the second padded region to the second male coupling region between the dorsal pad and the base member.

* * * * *